US006530572B1

(12) United States Patent
Overley

(10) Patent No.: US 6,530,572 B1
(45) Date of Patent: Mar. 11, 2003

(54) BULLET TRAP

(76) Inventor: Charles E. Overley, 410 S. Main, St. Marys, OH (US) 45885

( * ) Notice: Subject to any disclaimer, the term of this patent is extended or adjusted under 35 U.S.C. 154(b) by 0 days.

(21) Appl. No.: 09/965,261

(22) Filed: Sep. 27, 2001

(51) Int. Cl.[7] ..... F41J 1/12
(52) U.S. Cl. ..... 273/410
(58) Field of Search ..... 273/403–410

(56) References Cited

U.S. PATENT DOCUMENTS

| | | | | | |
|---|---|---|---|---|---|
| 2,013,133 | A | * | 9/1935 | Cashwell | 273/406 |
| 4,126,311 | A | * | 11/1978 | Wagoner | 273/410 |
| 4,475,734 | A | * | 10/1984 | Clarke, III et al. | 273/410 |
| 4,819,946 | A | | 4/1989 | Kahler | |
| 5,121,671 | A | * | 6/1992 | Coburn | 273/410 |
| 5,486,008 | A | | 1/1996 | Coburn | |
| 5,607,163 | A | * | 3/1997 | Nesler | 273/410 |
| 5,715,739 | A | | 2/1998 | White | |
| 5,811,718 | A | * | 9/1998 | Bateman | 273/394 |
| 6,311,980 | B1 | * | 11/2001 | Sovine et al. | 273/410 |

FOREIGN PATENT DOCUMENTS

| | | | |
|---|---|---|---|
| DE | 3308664 | * | 9/1984 |
| FR | 2613473 | * | 4/1987 |

* cited by examiner

*Primary Examiner*—Mark S. Graham
(74) *Attorney, Agent, or Firm*—Woodard, Emhardt, Naughton, Moriarty & McNett LLP

(57) ABSTRACT

A trap for receiving and holding bullets and fragments thereof. A funnel shaped receiver is mounted atop a frame and has a narrow exit connected to a collector tube arranged at an acute angle relative to the longitudinal axis of the receiver. The collector tube empties into a circular chamber of an offset housing dissipating the kinetic energy of the bullet.

15 Claims, 4 Drawing Sheets

BULLET TRAP

BACKGROUND OF THE INVENTION

The present invention relates generally to the field of traps for catching and holding bullets.

DESCRIPTION OF THE PRIOR ART

A variety of devices have been provided for catching and holding bullets during target practice. Such traps are designed to receive and de-energize the bullet and to guide the bullet to a storage container for subsequent removal. One approach, such as disclosed in U.S. Pat. No. 4,819,946 utilizes a plurality of panels to sequentially absorb the energy from the bullet. Another approach is shown in U.S. Pat. No. 4,475,734 incorporating a water chamber in the trap to de-energize the bullet. Yet a further approach is disclosed in U.S. Pat. No. 5,486,008 wherein the trap utilizes a chamber having a curved path through which the bullet is directed to dissipate the bullet kinetic energy. The chamber is designed to direct the bullet in a path around a generally horizontal axis. In U.S. Pat. No. 5,715,739, a similar type of chamber is utilized only the bullet is directed around a generally vertically extending axis.

Bullets have a tendency to fragment upon impact. Likewise, the bullets and fragments thereof may ricochet off of the impacted surface and fly outwardly in a variety of directions. Safety concerns exist with the prior bullet traps due to the bullet fragmentation and possible ricocheting of both the bullet and fragment. Disclosed herein is a bullet trap designed to capture and hold not only the bullet but any fragments thereof. Further, the energy-dissipating chamber is located offset relative to the trap entrance to limit ricocheting of the bullet and fragments out of the chamber in a reverse direction through the trap entrance. In addition, the chamber is provided with a centrally located baffle or member to prevent the bullet and fragments entering the chamber to strike perpendicularly the walls of the chamber thereby minimizing any ricocheting affect.

SUMMARY OF THE INVENTION

One embodiment of the present invention is a trap for receiving and de-energizing a bullet comprising a funnel shaped receiver having a wide entrance and a narrow exit for a bullet to pass therethrough. The receiver has sidewalls converging from the entrance to the exit to guide the bullet toward the exit and further has a center axis extending from the entrance to the exit between the sidewalls. An energy dissipating housing has a circular interior surface with an opening connected to the exit to receive and direct the bullet into a circular path decreasing the kinetic energy of the bullet. A collector tube is connected to the receiver and the housing and extends between the exit and the opening to direct the bullet from the receiver to the housing. The collector tube includes a longitudinal axis arranged at an included acute angle relative to the center axis with the opening on the longitudinal axis off set from the center axis and the exit to limit movement of the bullet and any fragments thereof from the housing through the receiver. A container receives the bullet from the housing.

It is an object of the present invention to provide a new and improved bullet trap.

A further object of the present invention is to provide a bullet trap for catching and holding bullets and fragments thereof.

Yet a further object of the present invention is to provide a bullet trap having means for limiting escape of the bullet and fragments from the trap.

Related objects and advantages of the present invention will be apparent from the following description.

DESCRIPTION OF THE PREFERRED EMBODIMENT

Figure 1:
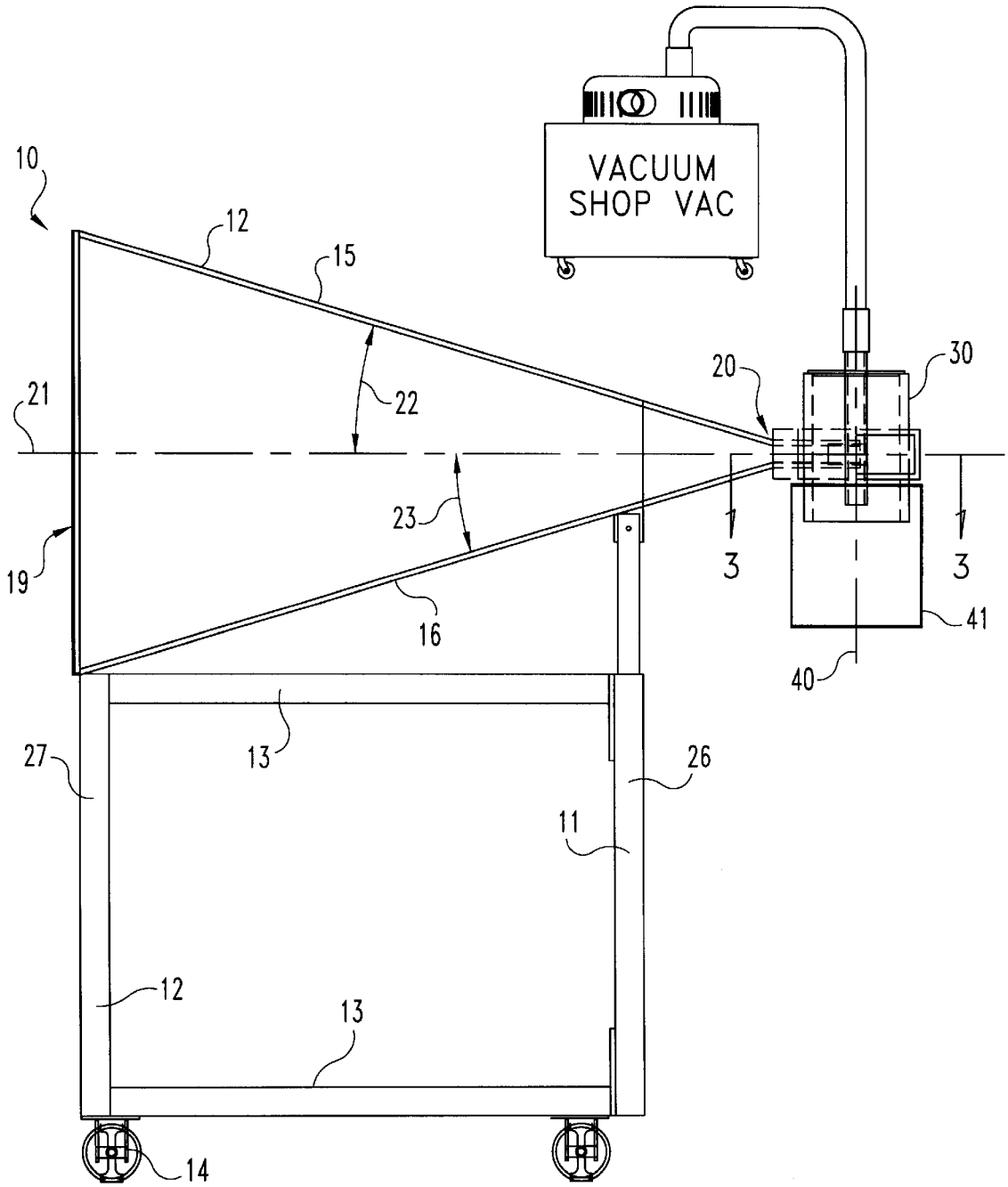
FIG. 1 is a side view of the bullet trap incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a bullet trap 10 including a main frame 11 with a funnel shaped bullet receiver 12 fixedly mounted thereatop. Frame 11 includes a plurality of upright columns 12 fixedly attached to horizontally extending beams 13 with a plurality of wheels 14 rotatably mounted to the bottom thereof to facilitate movement of the trap.

Figure 2:
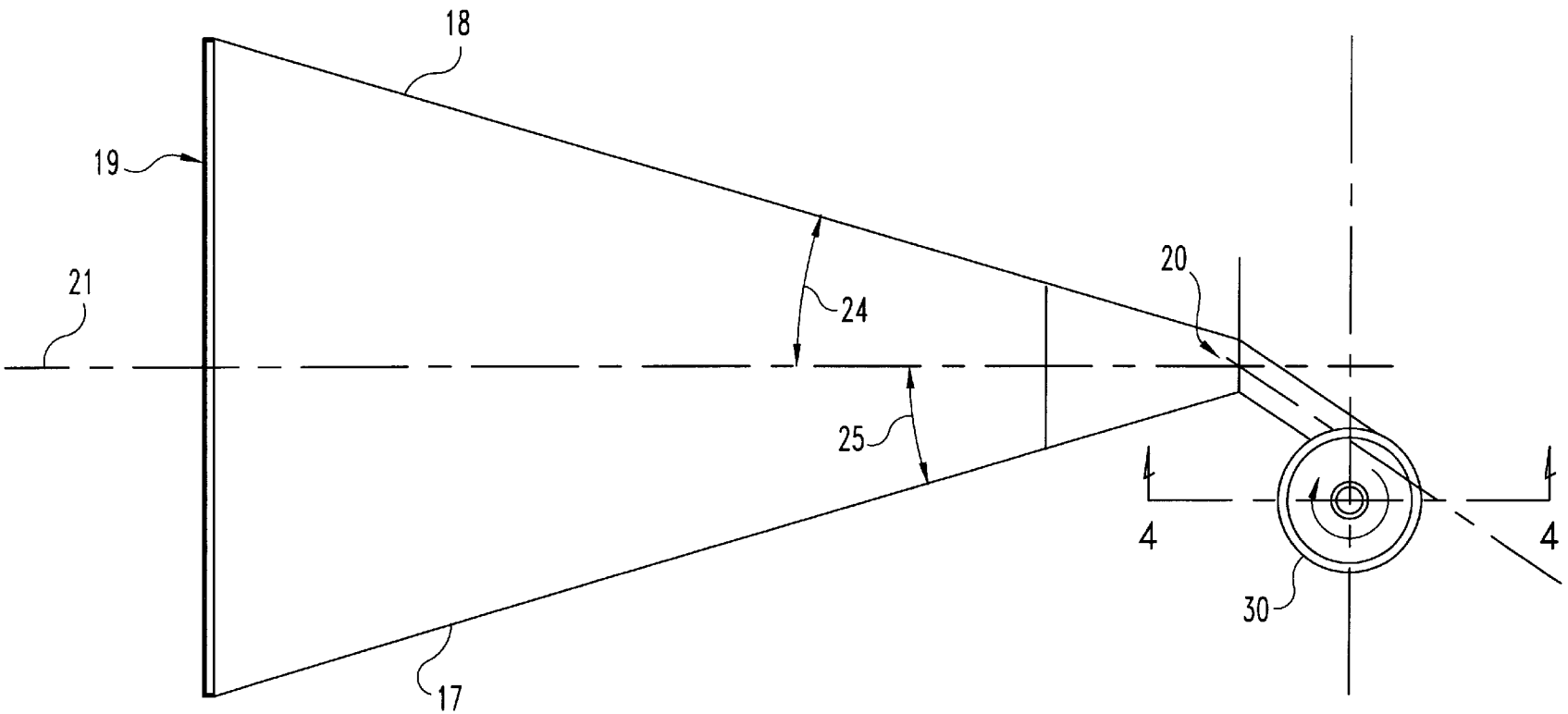
FIG. 2 is a top view of the trap of FIG. 1.

Receiver 12 includes a top wall 15, bottom wall 16, and a pair of side walls 17 and 18 converging from the wide entrance 19 to the narrow exit 20 thereby guiding the bullet entering the receiver through entrance 19 toward exit 20. A center axis 21 extends from entrance 19 to exit 20 and is located equidistant from sidewalls 17 and 18 and equidistant from top wall 15 and bottom wall 16. In the embodiment shown in FIGS. 1 and 2, the included angle 22 between top wall 15 and center axis 21 is approximately 17 degrees plus or minus 5 degrees. Likewise, the included angle 23 between bottom wall 16 and axis 21 is the same as angle 22. Further, the included angle 24 between sidewall 18 and axis 21 is the same angle as angle 22 with the included angle 25 between sidewall 17 and axis 21 also being the same angle as angle 22. Axis 21 extends horizontally and thus the rear column 26 of frame 11 extends higher than the forward column 27 with the two columns fixedly attached to bottom wall 16.

Figure 3:
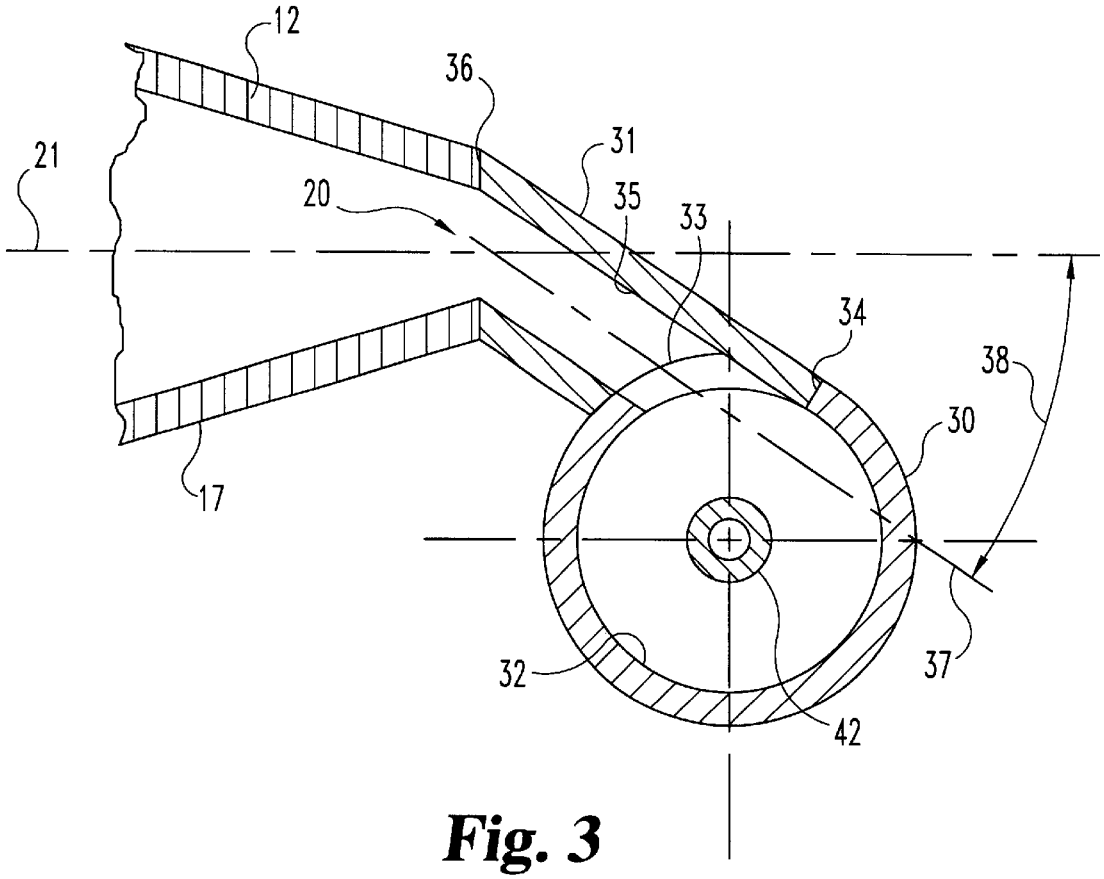
FIG. 3 is an enlarged fragmentary cross-sectional view taken along the line 3—3 of FIG. 1 and viewed in the direction of the arrows.

An energy dissipating housing 30 (FIG. 3) is connected via a collector tube 31 to exit 20 of receiver 12. Housing 30 has a circular interior surface 32. End 34 of collector tube 31 opens into entrance 33 of housing 30 with the interior surface 35 of tube 31 being arranged tangentially relative to the circular interior surface 32. The opposite ends 34 and 36 of collector tube 31 are affixed respectively to housing 30 and receiver 12 at the respective locations of opening 33 and exit 20. The longitudinal axis 37 extending centrally through tube 31 is arranged and intersects axis 21 forming an included angle 38 of approximately 34 degrees thereby offsetting housing 30 relative to receiver 12 and the longitudinal axis 21. Collector tube 31 extends horizontally locating housing 30 on the side of axis 21 closest to sidewall 17 and farthest from sidewall 18.

Housing 30 includes a vertical axis 40 extending centrally through the housing and equidistant from the circular interior surface 32. Thus, a bullet entering receiver 12 through entrance 19 will be directed by walls 15–18 toward exit 20 and into collector tube 31 passing through opening 33 thereby contacting interior surface 32 and being guided in a clockwise direction as viewed in FIG. 3 around axis 40. Eventually, the kinetic energy of the bullet and fragments thereof will decrease as the bullet and fragments continue the clockwise motion within the housing until the bullet and fragments drop through the open bottom of housing 30 falling into container 41 removably attached to the bottom of housing 30.

Figure 4:
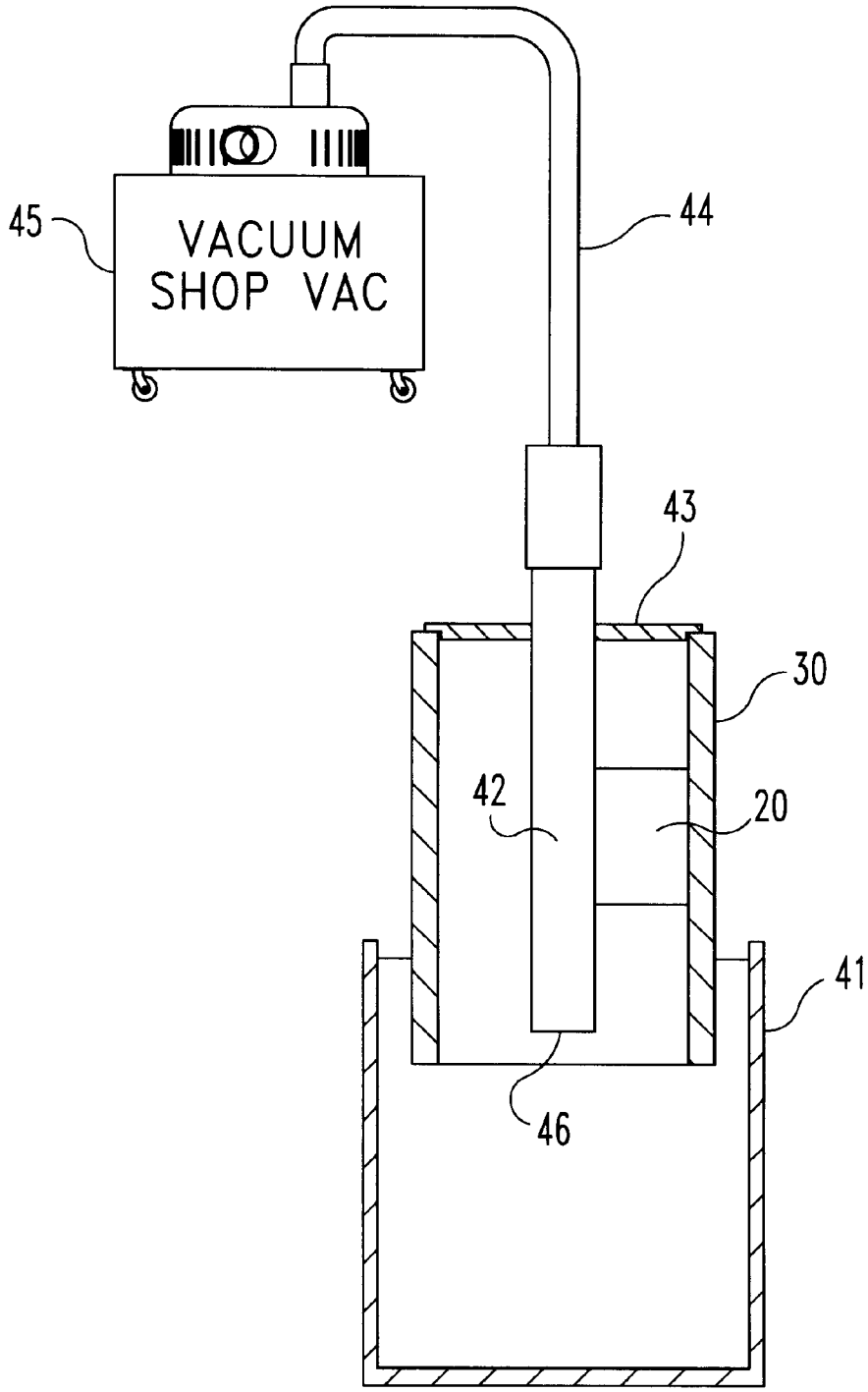
FIG. 4 is an enlarged cross-sectional view taken along the line 4—4 of FIG. 2 and viewed in the direction of the arrows.

An elongated member 42 (FIG. 4) is fixedly attached and suspended from a plate 43 mounted to the top end of housing 30. Member 42 is located equidistant from interior surface 32 and extends along vertical axis 40. A passage extends through the hollow interior of member 42 from the bottom end 46 of the member to the top end of the member whereat member 42 is connected by conduit 44 to a reduced air pressure pump 45. Pump 45 is operable to withdraw, dust and other particles from within housing 30 through member 42. The bottom end 46 of member 42 is located above the bottom end of housing 30 with standard fastening devices utilized to removably mount container 41 to housing 30. Interior surface 32 is located radially outward from vertical axis 40 and is in line with and arranged tangentially to surface 35 of collector tube 31 which extends from exit 20.

By offsetting housing 30 from axis 21, and then guiding the bullet and fragments along the length of collector tube 31 into a circular path about vertical axis 40, the bullet and fragments thereof are limited from moving in a reverse direction back through collector tube 31 and then out through entrance 19 of receiver 12. Collector tube 31 provides a horizontal path for the bullet and fragments to move into housing 30. By locating elongated member 42 in the center of housing along axis 40, the bullet and fragments are limited from directly crossing axis 40 thereby reducing the possibility the bullet and fragments will ricochet and escape housing 30 through tube 31. Collector tube 31 is skewed by angle 38 relative to axis 21 thereby limiting the movement of the bullet from the chamber of housing 30 back to receiver 12. The receiver, collector tube and chamber of housing 30 define an air passage through which the bullet and fragments move to container 41.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A trap for receiving and de-energizing a bullet comprising:

a funnel shaped receiver having a wide entrance and a narrow exit for a bullet to pass therethrough, said receiver having side walls converging from said entrance to said exit to guide the bullet toward said exit and further having a center axis extending from said entrance to said exit between said side walls;

an energy dissipating housing having a vertical axis and a circular interior surface surrounding said vertical axis with an opening connected to said exit to receive and direct the bullet into a circular path around said vertical axis decreasing the kinetic energy of the bullet, said housing having an outlet for the bullet to move therethrough after following the circular path;

a collector tube connected between said receiver and said housing and extending from said exit to said opening to direct the bullet from said receiver to said housing, said collector tube including a longitudinal axis arranged at an included acute angle relative to said center axis with said opening off set from said center axis and said exit to limit movement of the bullet and any fragments thereof from said housing through said receiver;

an elongated vertical member mounted to said housing and extending longitudinally along said vertical axis being located offset from said longitudianal axis, said circular interior surface surrounding said vertical axis limiting movement of the bullet across said vertical axis to limit the bullet from ricocheting from said housing and out said receiver; and, a container to receive the bullet moving through said outlet.

2. The trap of claim 1 wherein:

said collector tube includes an interior surface that extends from said exit to said opening in line with and arranged tangentially to said circular interior surface.

3. The trap of claim 2 wherein:

said circular interior surface is located radially outward from said vertical axis, said longitudinal axis extends horizontally so said collector tube directs the bullet along a horizontal path as it enters said housing tangentially with said circular interior surface.

4. The trap of claim 3 and further comprising:

a source of reduced air pressure connected to said elongated member which is hollow to remove dust and particles from within said housing.

5. The trap of claim 4 and further comprising:

a plate connected to said elongated member and mounting said elongated member to said housing.

6. The trap of claim 3 wherein:

said sidewalls are arranged at a predetermined included acute angle relative to said center axis, said longitudinal axis intersects said center axis at an included acute angle.

7. A bullet trap comprising:

a funnel shaped receiver having a wide entrance and a narrow exit for a bullet to pass therethrough, said receiver having side walls converging from said entrance to said exit to guide the bullet toward said exit and further having a center axis extending from said entrance to said exit between said side walls;

a energy dissipating housing having a vertical axis and a circular interior surface surrounding said vertical axis, said housing having an opening connected to said exit to receive and direct the bullet into a circular path around said vertical axis decreasing the kinetic energy of the bullet, said housing having an outlet for the bullet to move therethrough after following the circular path;

an elongated member mounted to said housing that extends along said vertical axis limiting the bullet from ricocheting from said housing and out said receiver; and, a receptacle to receive the bullet moving through said outlet.

8. The trap of claim 7 and further comprising:

a source of reduced air pressure connected to said elongated member which is hollow to remove dust and particles from within said housing.

9. The trap of claim 8 and further comprising:

a plate connected to said elongated member and mounting said elongated member to said housing.

10. A bullet trap comprising:

a main frame;

a funnel shaped receiver for catching a bullet and having an outlet;

a housing attached to said receiver and having an inlet aligned with said outlet to receive the bullet from said receiver, said housing having an interior energy dissipating chamber with a vertical axis and a curved interior surface extending around said axis for the bullet to follow, said housing having an exit for said bullet to exit said chamber; and, a center member vertically extending centrally in said chamber to limit movement of the bullet out of said housing and into said receiver.

11. The trap of claim 10 and further comprising:

a receptacle aligned with said exit to receive and hold the bullet.

12. The trap of claim 11 and further comprising:

a source of negative air pressure connected to said center member which is hollow to withdraw dust within said chamber.

13. The trap of claim 10 and further comprising:

a tube extending from said receiver to said housing and directing the bullet into said chamber, said receiver having a center longitudinal axis with said tube skewed relative to said center longitudinal axis to limit movement of the bullet from said chamber to said receiver.

14. The trap of claim 13 and further comprising:

a plurality of wheels mounted to said frame to allow the trap to be moved.

15. The trap of claim 13 wherein:

said receiver, said tube, and said chamber defines an air passage through which the bullet moves to said receptacle.

* * * * *